United States Patent [19]

Kulesza et al.

[11] 4,214,749

[45] Jul. 29, 1980

[54] TARGET GAME APPARATUS

[75] Inventors: Ralph J. Kulesza, Chicago; Jeffrey D. Breslow, Highland Park, both of Ill.

[73] Assignee: Marvin Glass & Associates, Chicago, Ill.

[21] Appl. No.: 876,403

[22] Filed: Feb. 10, 1978

[51] Int. Cl.[2] ..... A63F 9/00

[52] U.S. Cl. ..... 273/1 R; 272/31 R

[58] Field of Search ..... 273/1 R, 1 E, 101, 95 B, 273/105.2; 272/31 A, 31 R

[56] References Cited

U.S. PATENT DOCUMENTS

| | | | |
|---|---|---|---|
| 1,790,405 | 1/1931 | Brown | 273/95 B |
| 2,280,623 | 4/1942 | Broomfield | 273/105.2 |
| 2,510,169 | 6/1950 | Caler | 272/31 A |
| 2,657,930 | 11/1953 | Reus | 273/95 B |
| 3,047,295 | 7/1962 | Sachs | 273/105.2 |
| 3,222,066 | 12/1965 | Durrell | 273/1 R |
| 3,272,507 | 9/1966 | Grau | 272/31 A |
| 3,383,110 | 5/1968 | Brown | 273/95 B |
| 3,949,986 | 4/1976 | Breslow | 273/1 R |

FOREIGN PATENT DOCUMENTS

| | | | |
|---|---|---|---|
| 1502789 | 3/1978 | United Kingdom | 272/31 A |

*Primary Examiner*—Anton O. Oechsle

*Attorney, Agent, or Firm*—Mason, Kolehmainen, Rathburn & Wyss

[57] ABSTRACT

A target game includes a platform mounted in spaced apart relationship to a base and a plurality of targets with target portions thereon, and a plurality of targets positionable on the platform. A drive mechanism mounted on the base rotatably drives generally vertically a shaft which extends through an opening in the platform and which has a striking element slidably mounted thereon and constrained to rotate with the shaft. A control lever pivotally mounted on the platform controls the vertical movement of the striking element along the shaft so that as the striking element rotates, the striking element may be elevated with respect to the platform to strike various ones of the target portions. A stop member projects from the platform to be selectively engaged with the striking element to prohibit the rotation of the striking element until the game is initiated.

5 Claims, 4 Drawing Figures

TARGET GAME APPARATUS

BACKGROUND OF THE INVENTION

1. Field of the Invention

This invention relates to amusement devices, and more particularly, to round-about target type games where the object is to hit a stationary target or targets with a moving striking element.

2. Description of the Prior Art

Round-about toys have enjoyed a great deal of popularity through the years. Some of these toys consist of a figure traveling a given circuitous path on a platform and have been modified for use in games. The object of many of these games is to hit a moving target or hit a stationary target with a striking element which is moving in relation to the target.

SUMMARY OF THE INVENTION

The principal object of this invention is to provide a toy game which includes a striking element that is driven in a circuitous path while being selectively moved in relationship to a platform on which are located stationary figures comprising targets. The game requires skill on the part of the operator in effecting contact between the moving striking element and the stationary figures comprising the targets.

A further object of the present invention is to provide such a toy game having a drive mechanism to rotate the striking element in a circuitous path while enabling an operator to selectively move the striking element in a path generally perpendicular to the plane of the platform on which the various targets are located in order that the striking element can make contact with the targets.

Yet another object of the present invention is to provide a plurality of targets wherein the target portions on each of the targets are positioned on the target so as to be displaced at different distances from a platform on which the targets are located so that as a striking element is rotated above the platform, an operator must properly control the elevation of the striking element with respect to the platform in order for the striking element to make contact or hit the different target portions on the targets.

These and other objects are accomplished in form of the invention currently contemplated by providing a platform located on a plurality of pedestals extending from a supporting structure. Various target positioning means are disposed on the platform about the outer periphery of the platform and each is adapted to receive a target taking the form of a tree or the like with target portions projecting from the target. A drive mechanism is mounted on the supporting structure and a vertical shaft extends from the drive mechanism through a centrally located opening in the platform. A striking element, which can be considered a cutting tool for the trees, is slidably mounted on the shaft and is constrained to rotate with the shaft. A control lever is located between the supporting structure and the platform to selectively move the striking element along the shaft relative to the platform as the striking element is rotated about a circuitous path above the platform so that the striking element may make contact or engage the target portions of the target figures. The drive mechanism is energized by the rotation of the striking element in a direction opposite to the direction in which the drive mechanism normally drives the striking element in the circuitous path and a stop member projects from the top of the platform and engages the striking element to maintain it in a starting position until the game is initiated.

Figure 1:
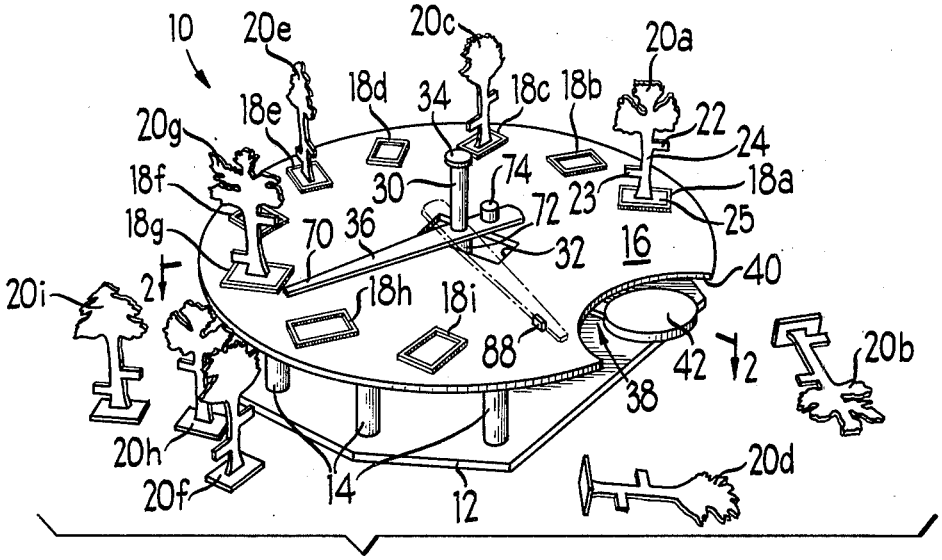
FIG. 1 is a perspective view of the game of this invention.

While this invention is susceptible of embodiment in many different forms, there is shown in the drawings and will herein be described in detail a specific embodiment therefor, with the understanding that the present disclosure is to be considered as an exemplification of the principles of the invention and is not intended to limit the invention to the embodiment illustrated.

DESCRIPTION OF THE PREFERRED EMBODIMENT

Referring now more specifically to FIG. 1 of the drawings, therein is disclosed a round-about target type game apparatus which is generally designated by the number 10 and which embodies the present invention. The toy game apparatus 10 includes a supporting structure 12 with a multiplicity of pedestals, such as pedestals 14, projecting therefrom, on which is mounted a playing surface or platform 16 having along its outer periphery a number of stations defining target positioners or holders **18*a*–18*i*. Each of the target positioners 18*a*–18*i* is adapted to receive therein a target figure, such as the target figures 20*a*–20*i*, which in the disclosed embodiment are in the shape of trees. Each of the target figures 20*a*–20*i* have target portions 22 and 23, as illustrated in connection with target figure 20*a*, projecting from an upright portion 24 which extends from a base 25 designed to fit into the target positioner 18*a***.

Figure 2:
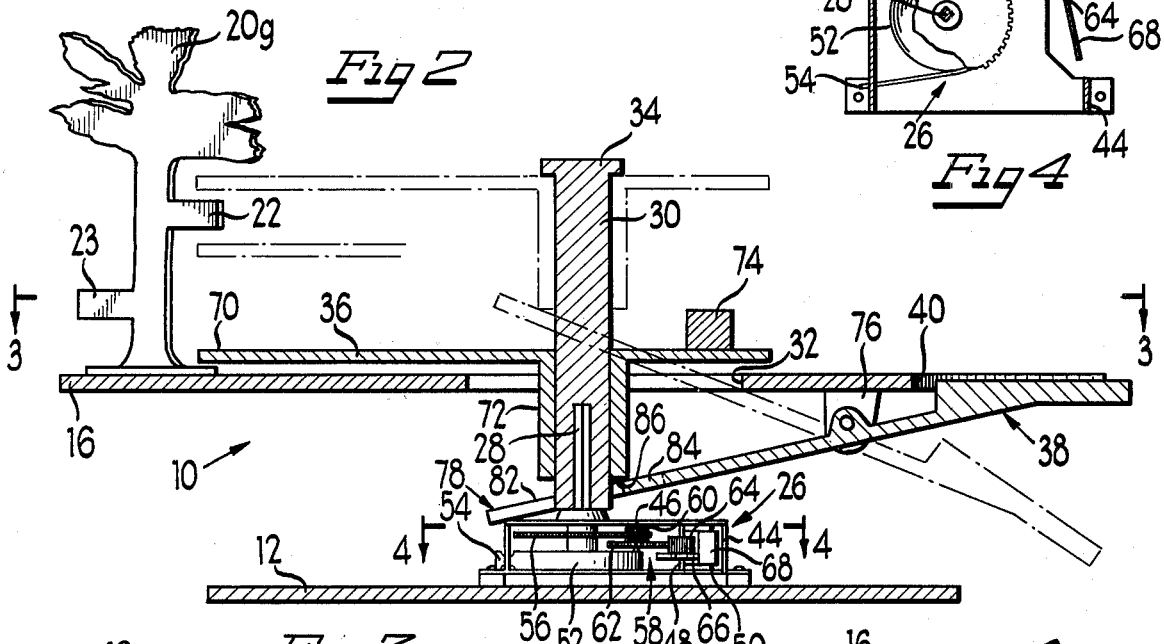
FIG. 2 is a sectional view taken generally along line 2—2 of FIG. 1.

As can be best seen in FIG. 2 of the drawings, a drive mechanism 26 is mounted on the supporting structure 12 and has a main shaft 28 extending therefrom. Another shaft 30 is connected to the main shaft 28 and extends upward from the drive mechanism 26 through an opening 32 centrally located in the platform 16. The shaft 30 has an enlarged portion or button 34 at its top end. A striking element 36 is slidably mounted on the shaft 30 and is constrained by complimentary flat surfaces to rotate with the shaft 30 as it is being driven by the drive mechanism 26 through the shaft 28.

The vertical position of the striking element 36 along the shaft 30 is controlled by a manually operative control lever 38 pivotally mounted on the platform 16 and accessable through an opening 40 in the platform 16. As the control lever 38 is depressed on a control end or button 42, the striking element 36 moves upwardly along the shaft 30 towards the enlarged or button portion 34 such that as the striking element 36 is rotated in a circuitous path relative to the platform 16, the control lever 38 enables the striking element 36 to be moved relative to the plane of the platform 16 so that the striking element 36 may engage or strike the target portions 22 or 23 on any of the targets **20*a*–20*i* located in the various ones of the target positioners 18*a*–18*i* disposed on the top of the platform 16**.

More specifically, the supporting structure 12 forms a base for the game 10 and has pedestals 14 extending upwardly on which is mounted the platform 16 so that the platform 16 is maintained a distance from the supporting structure or base 12. By having the platform 16 so spaced from the base 12, the drive mechanism or motor 26 and the control lever 38 may be disposed between the supporting structure 12 and the platform 16.

Figure 4:
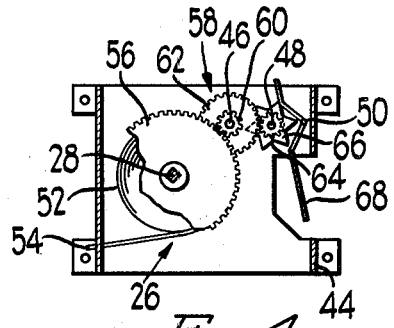
FIG. 4 is a sectional view taken generally along the line 4—4 of FIG. 2.

The drive mechanism 26 includes a supporting frame structure 44 secured to the base 12 by appropriate fastening means. The frame structure 44 has a hole through which the main vertical shaft 28 extends and three additional vertical shafts 46, 48 and 50 are located within the supporting structure 44 and support the elements of a gear train. A coil spring 52 is fixed to the main vertical shaft 28 and has a slotted end portion 54 fixed to the frame 44 to yieldingly resist the turning of the main vertical shaft 28 and urge the rotation of the main vertical shaft 28 in a clockwise direction as viewed in FIG. 4.

A gear 56 is keyed to the main vertical shaft 28 and has its toothed portion in position for engagement with a speed reduction gear train generally designated as 58. The gear train 58 includes a pinion gear 60 mounted on the shaft 46 for engagement with the gear 56. Another larger gear 62 is also fixed on the shaft 46, which gear 62 engages another pinion gear 64 mounted on the adjacent shaft 48. By virtue of the gear train 58, the shaft 48 rotates at a substantially faster rate than the main vertical shaft 28. The shaft 48 also has a star gear 66 rotatably mounted thereon and adapted to engage a bifurcated element 68 having its mid portion disposed for pivotal rotation relative to the shaft 50.

Figure 3:
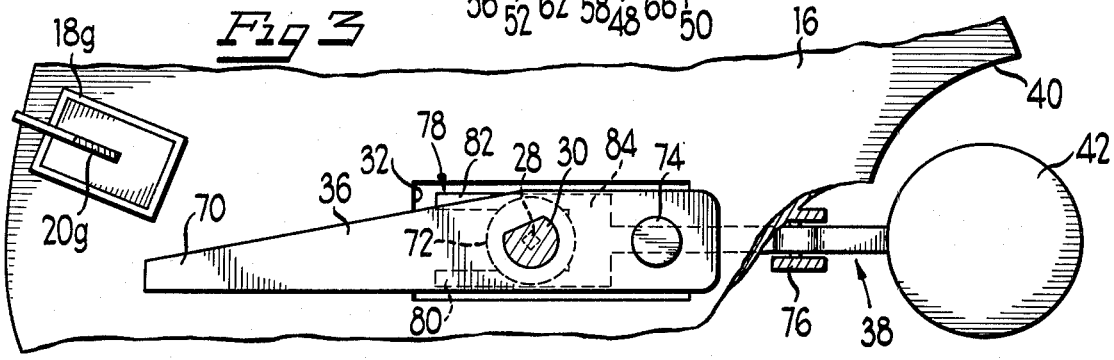
FIG. 3 is a partially cut away sectional view taken generally along the line 3—3 of FIG. 2.

The winding of the shaft 28 by means of rotating the striking element 36 in a counterclockwise direction as viewed in FIG. 1 or FIG. 3 causes the spring 52 to be coiled or to be in a resiliently biased configuration. When the shaft 28 is released as by releasing the striking element 36, the unwinding of the spring 52 and its pressure against the frame 44 through the attachment end 54 causes the gear 56 to move in a clockwise direction as viewed in FIG. 4 in engagement with the pinion gear 60. As the pinion gear 60 moves, it causes the gear 62 to move counterclockwise in engagement with the pinion gear 66. The movement of the pinion gear 64 causes the star gear 66 to rotate in a clockwise direction, and thereby causes the gear train 58 to operate.

As the star gear 66 rotates, it alternately strikes opposite ends of the bifurcated element 68 to provide a governor for regulating the speed and also can create a noise similar to a ticking sound. This enables the ticking sound to be generated whenever the striking element 36 is rotating above the surface of the platform 16 during the operation of the game 10.

As previously indicated, the platform 16 is maintained in spaced apart relationship to the base 12 by the pedestals 14. Along the top outer peripheral surface of the platform 16 are located the target positioners **18*a*–18*i*. Each of the target positioners 18*a*–18*i* are capable of receiving one of the targets 20*a*–20*i*. As illustrated in FIG. 1, the target 20*a* is located in target positioner 18*a*, the target 20*c* is positioned in target positioner 18*c*, the target 20*e* is positioned in target positioner 18*e* and the target 20*f* is positioned in target positioner 18*f*. Any one of the targets 20*a*–20*i* can be positioned in any one of the target positioners 18*a*–18*i*. As illustrated in connection with the target 20*a*, each of the targets 20*a*–20*i* have target portions 22 and 23 projecting from opposite sides of the upright portion 24 of the target 20*a*. In the disclosed embodiment, each of the targets 20*a*–20*i* is in the shape of a tree with the top portion in the form of various leaves or branches and the target portions 22 and 23 projecting from the upright portion 24 in the form of a trunk or stem portion of the tree. Hence since the striking element 36 can be considered a cutting or chopping tool, the game 10 can be designated as a timber game. However, various other forms of such targets 20*a*–20*i* can be utilized in the game 10** of the present invention.

The target portion 22 extends from one side of the trunk portion 24 of the target **20*a* at a level from the base 25 that is different than any of the other target portions on the remaining target 20*b*–20*i*. Likewise, the target portion 23 extends from the target 20*a* at a distance above the base 25 of the target figure 20*a*, a distance different than the target portion 22 and different than any of the other target portions on the other targets 20*b*–20*i*. This is done so that as the striking element 36 rotates above the platform 16, the elevation of the striking element 36 must be selectively changed in order for it to strike any of the target portions, such as the target portion 22 or 23 on the target 20*a***.

Referring now more specifically to FIGS. 1, 2 and 3, the shaft 30 is generally D-shaped in cross-section, as seen in FIG. 3, and has mounted thereon in slidable relationship the striking element 36. The striking element 36 has a striking portion 70 which extends outwardly from a barrel portion 72 mounted about the shaft 30. The barrel portion 72 has an inner hole that is similarly D-shaped so that it is keyed to the shaft 30 and is constrained to rotate as the shaft 30 rotates. A counterweight 74 is disposed on the striking element 36 on the side opposite to the striking portion 70 so that the striking portion 70 is maintained generally parallel to the platform 16.

In order to move the striking element 36, and more particularly the barrel portion 72, along the shaft 30 from a position as shown in FIG. 2 to, for instance, the positions illustrated in phantom lines in FIG. 2, the control lever 38 is moved from the position shown in FIG. 2 to the position shown in the phantom lines in FIG. 2. More specifically, the control lever 38 has an actuating button 42 at one end which is accessable through the hole 40 in the platform 16. The lever 38 is pivotally hinged to the platform 16 by a pivot or hinge mechanism 76. A generally U-shaped portion 78 is located at the other end of the control lever 38 and has leg portions 80 and 82 straddling the lower end of the shaft 30. As best can be seen in FIGS. 2 and 3, the leg portions 80 and 82, as well as the bight portion 84 of the U-shaped structure 78, contacts the lower end 86 of the barrel portion 72 of the striking element 36 such that as the button portion 42 is forced in a downwardly direction, as viewed in FIG. 2, the U-shaped structure 78 is forced upwardly, as viewed in FIG. 2, thereby forcing the striking element 36 to rise along the shaft 30 through the access hole 32 in the central portion of the platform 16. The access hole 32 is generally rectangular in shape so that the control lever 38 and particularly the U-shaped portion 78 may extend through the hole 32 as it forces the striking element 36 upwardly towards the enlarged portion 34 of the shaft 30. The enlarged portion or button 34 functions as a restraining mechanism or stop so that the striking element 36 may not be lifted off of the shaft 30.

Consequently, as the shaft 30 is rotated by the drive mechanism 26, the striking element 36 can be lifted along the shaft 30 by an operator. If the button portion 42 of the control lever 38 is properly moved, the striking element 36 and particularly the striking portion 70 are moved to a level above the platform 16 that is at the same level as the target portion 22 or 23 on one or more of the targets 20*a*–20*i*. If the striking portion 70 of the striking element 36 contacts one of these target portions 22 or 23, then that target 20*a*–20*i* will be knocked off the platform 16.

Accordingly, the play of the game 10 is relatively simple and can be enjoyed by two or more players. One of the players sets the various targets 20*a*–20*i* in the various ones of the target positioners 18*a*–18*i* located on the platform 16. The targets 20*a*–20*i* are so positioned in those target positioners 18*a*–18*i* such that either the target portion 22 extends towards the shaft 30 or the target portion 23 extends towards the shaft 30.

Before or after the targets 20*a*–20*i* are so positioned, the striking element 36 is wound in a counterclockwise manner (as viewed in FIGS. 1 and 3). The coil spring 52 is thereby placed in its coiled condition and the striking element 36 is restrained from movement or placed in its starting position by being lowered on the platform 16 so as to engage a stop member 88 projecting from the top of the platform 16. The positioning of the striking element 36 in this start position is shown by the phantom lines in FIG. 1.

In order to initiate the game, the control button 42 is depressed so that the striking element 36 is raised above the stop member 88 and allowed to be rotated clockwise by the drive means mechanism 26. As the striking element 36 is so rotated, the control lever 38 and particularly the control button 42 is properly depressed by the player so as to try and have the striking element 36 and particularly the striking portion 70 at the same level as one or more of the target portions 22 or 23 on the target figures 20*a*–20*i*. The striking element 36 can be allowed to rotate a fixed number of times, such as one time, and the person controlling the control lever 38 will score a point for each target figure 20*a*–20*i* that has been struck by the striking element 36. If desired, the striking element 36 may be rotated more than one full revolution for each play of the game. After a given number of turns for each of the players with respect to controlling the control lever 38 and the positioning of the targets 20*a*–20*i*, the player who has knocked down the most target figures 20*a*–20*i* with the striking element 36 is declared the winner of the game.

Certainly, different variations of the play and scoring for the game 10 can be devised. In playing the game 10, the number of targets 20*a*–20*i* used can be varied or the number of revolutions the striking element 36 travels for each of the player's turns can be varied. Moreover, different colored or shaped target figures 20*a*–20*i* may be utilized such that certain ones of the target figures 20*a*–20*i* might have a different value for each time it is struck by the striking element 36. This can be particularly the case with respect to the width of the target portion 22 and 23 used on each of the target figures 20*a*–20*i*.

The foregoing detailed description has been given for clearness of understanding only and no unnecessary limitations should be understood therefrom as some modifications will be obvious to those skilled in the art.

What is claimed and desired to be secured by Letters Patent of the United States is:

1. A game apparatus comprising:

a platform means defining a playing surface, target means disposed on said playing surface, striking means movable relative to said playing surface in a plane generally parallel to the playing surface and selectively engageable with said target means, drive means including a rotatable shaft means extending through said platform means, said striking means being slidably mounted on said shaft means and constrained to rotate with said shaft means for movement relative to said playing surface, and a control means associated with said striking means to control the engagement of said striking means with said target means by selectively controlling the sliding movement of the striking means on the shaft means, said control means being pivotally mounted below said platform means and having one end portion engageable with said striking means and an opposite end portion, on the other side of said pivot means, for selective manual operation by the user to control the movement of said striking means along the shaft means to vary the plane of movement thereof.

2. The game apparatus of claim 1, wherein each of said target means include at least two target areas for striking by the striking means and the platform means includes target mounting means for positioning only one of said target areas in the path of travel of said striking means.

3. A game apparatus comprising:

a platform means having target positioning means thereon, a plurality of target means adatped to be positioned in said target positioning means, said target means having target areas projecting therefrom, a rotatable shaft means extending through said platform means, drive means associated with said shaft means for rotating said shaft means, target actuating means slidably mounted on said shaft means, said target actuating means being constrained to rotate with said shaft means and in a plane normal to said shaft means, selectively operable control means associated with said target actuating means to slide said target actuating means along said shaft means to vary the plane of rotation along the vertical axis in an attempt to strike at least one of said target areas on said target means as said shaft means is rotated, and stop means extending from said platform means, said stop means being adaptable to engage said target actuating means such that said target actuating means is restrained from being rotated by said drive means until said control means selectively moves said target actuating means along said shaft so that said target actuating means is disengaged from said stop means.

4. A game apparatus comprising:

a platform means defining a playing surface, target means disposed on said playing surface, striking means movable relative to said playing surface in a plane generally parallel to the playing surface and selectively engageable with said target means, drive means including a rotatable shaft means extending through said platform means, said striking means being slidably mounted on said shaft means and constrained to rotate with said shaft means for movement relative to said playing surface, a control means associated with said striking means to control the engagement of said striking means with said target means by selectively controlling the sliding movement of the striking means on the shaft means, said control means being pivotally mounted below said platform means and having one end portion engageable with said striking means and an opposite end portion, on the other side of said pivot means, for selective manual operation by the user to control the movement of said striking means along the shaft means to vary the plane of movement thereof, and at least two target areas on each of said target means for striking by the striking means, said platform means including target mounting means for positioning only one of said target areas in the path of travel of said striking means, the target means being in the form and shape of trees whereby the movement of the striking means dislodging one of the target means simulates the felling of a tree.

5. A game apparatus comprising:

a platform means defining a playing surface;

target means disposed on said playing surface;

striking means movable relative to said playing surface in a plane generally parallel to the playing surface and selectively engageable with said target means, drive means including a rotatable shaft means extending through said platform means, said striking means slidably mounted on said shaft means and constrained to rotate with said shaft means for movement relative to the playing surface, said drive means being adjustable so as to rotate the striking means only one revolution, a control means associated with said striking means to control the engagement of said striking means with said target means by selectively controlling the sliding movement of the striking means on the shaft means, said control means being pivotally mounted below said platform means and having one end portion engageable with said striking means and an opposite end portion, on the other side of said pivot means, for selective manual operation by the user to control the movement of said striking means along the shaft means to vary the plane of movement thereof, and at least two target areas on each of said target means for striking by the striking means when the platform means includes a target mounting means for positioning only one of said target areas in the path of travel of said striking means.

* * * * *